US008197308B2

(12) United States Patent
Wang

(10) Patent No.: US 8,197,308 B2
(45) Date of Patent: Jun. 12, 2012

(54) SWING DEVICE FOR GRINDING MACHINE

(75) Inventor: Tain Wang Wang, Taiping (TW)

(73) Assignee: Mao Shan Machinery Industrial Co., Ltd., Taichung Hsien (TW)

( * ) Notice: Subject to any disclaimer, the term of this patent is extended or adjusted under 35 U.S.C. 154(b) by 453 days.

(21) Appl. No.: 12/458,849

(22) Filed: Jul. 24, 2009

(65) Prior Publication Data

US 2011/0021118 A1 Jan. 27, 2011

(51) Int. Cl.
*B24B 21/00* (2006.01)

(52) U.S. Cl. ..... 451/310; 451/296

(58) Field of Classification Search ..... 451/296, 451/297, 310

See application file for complete search history.

(56) References Cited

U.S. PATENT DOCUMENTS

| | | | | | |
|---|---|---|---|---|---|
| 3,922,820 | A * | 12/1975 | Wiltshire | ..... | 451/304 |
| 3,994,100 | A * | 11/1976 | Shelden et al. | ..... | 451/20 |
| 4,031,669 | A * | 6/1977 | Koide et al. | ..... | 451/304 |
| 5,359,813 | A * | 11/1994 | Kaiser et al. | ..... | 451/285 |
| 2011/0021118 | A1 * | 1/2011 | Wang | ..... | 451/310 |

* cited by examiner

*Primary Examiner* — Timothy V Eley

(57) ABSTRACT

A swing device for a grinding machine includes a motor located on a fixed table beside the sanding unit which includes a frame with two mandrels and a sanding belt is mounted to the two mandrels. A movable member is movably mounted to the shaft of the motor so as to move back and forth to activate two limit switches which are activated to stop the motor. The movable member is connected to a fixed plate connected to an end plate on the sanding unit and a link is connected between the fixed plate and an elongate slot of the movable member. The sanding unit together with the sanding belt swing when the movable member moves. The sanding belt swings and activates two micro switches to change the rotation direction of the shaft. The sanding belt swings to change the sanding portion contacting the objects to be polished.

5 Claims, 10 Drawing Sheets

SWING DEVICE FOR GRINDING MACHINE

BACKGROUND OF THE INVENTION (1) Field of the Invention

The present invention relates to a grinding machine, and more particularly, to a swing device for swing the sanding belt of a grinding machine.

(2) Description of the Prior Art

A conventional grinding machine for polishing surfaces of wood objects generally includes a sanding belt which is rotatably mounted to two mandrels and one of which is driven by a motor so as to grind the wood objects located beneath the lower mandrel. The sanding belt is rotated at high speed and can effectively polish the wood objects.

However, the sanding belt does not move parallel to the mandrels so that the objects are ground at the fixed portion of the sanding belt and this results in accumulation of debris on the grinding portion of the sanding belt and reduces the grinding efficiency. Besides, the objects could be burned due to the high speed grinding at the fixed portion of the sanding belt. Furthermore, the sanding belt needs to be replaced frequently because the sanding portion wears quickly.

The present invention intends to provide a swing device for changing the grinding portion of the sanding belt that is in contact with the objects so as to improve the drawbacks mentioned above.

SUMMARY OF THE INVENTION

The present invention relates to a swing device for grinding machine which includes a feeding table and a frame is located above the feeding table. Two mandrels are rotatably connected to the frame and a sanding belt is rotatably mounted to the two mandrels. The swing device comprises a fixed table connected to an end of the frame of the grinding machine and a motor is connected to a fixing member on the fixed table and includes a shaft which is rotatably supported on the support member. A movable member is movably mounted to the shaft and includes an elongate slot. A fixed plate is fixed to an end plate on an end of one of the two mandrels and has a hole. A link has a first end engaged with the hole and a second end of the link is movably inserted into the elongate slot. Two limit switches are connected on the fixed table and the movable member is movable between the two limit switches to activate two action ends of the two limit switches. Two micro switches are connected to a support frame and located on two sides of the sanding belt. The support frame supports one of the two mandrels.

The movable member is movable along the shaft and activates the two action ends of the two limit switches alternatively to stop operation of the motor. The micro switches are activated by the sanding belt to change rotation direction of the shaft. The support frame and the belt swing when the movable member moves so as to change the sanding portion contacting the objects.

The primary object of the present invention is to provide a swing device which swings the sanding belt such that the sanding belt does not polish the object by a fixed portion so as to improve the drawbacks of the conventional grinding machine.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
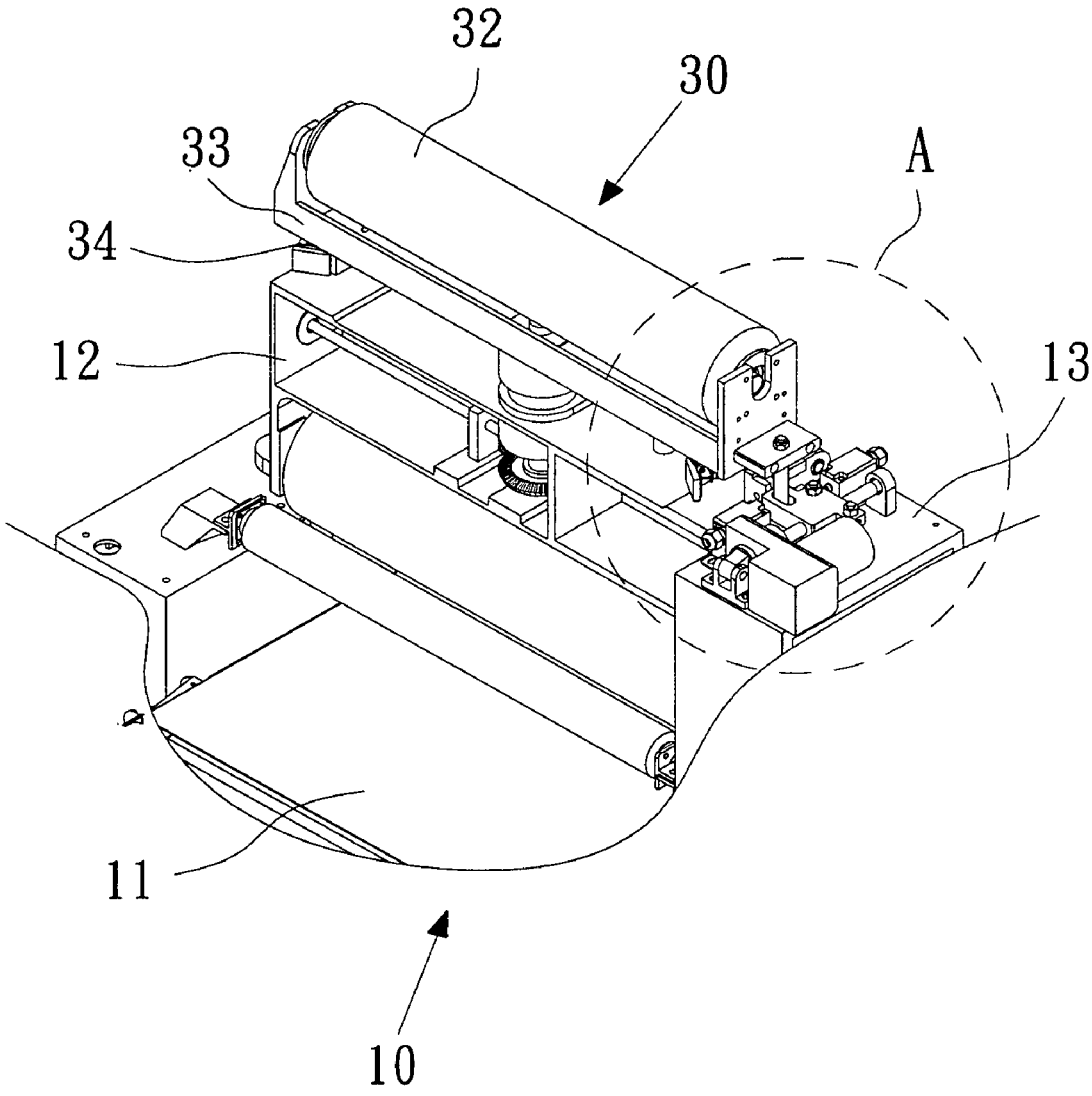
FIG. 1 is a perspective view to show the swing device of the present invention on a grinding machine.
Figure 2A:
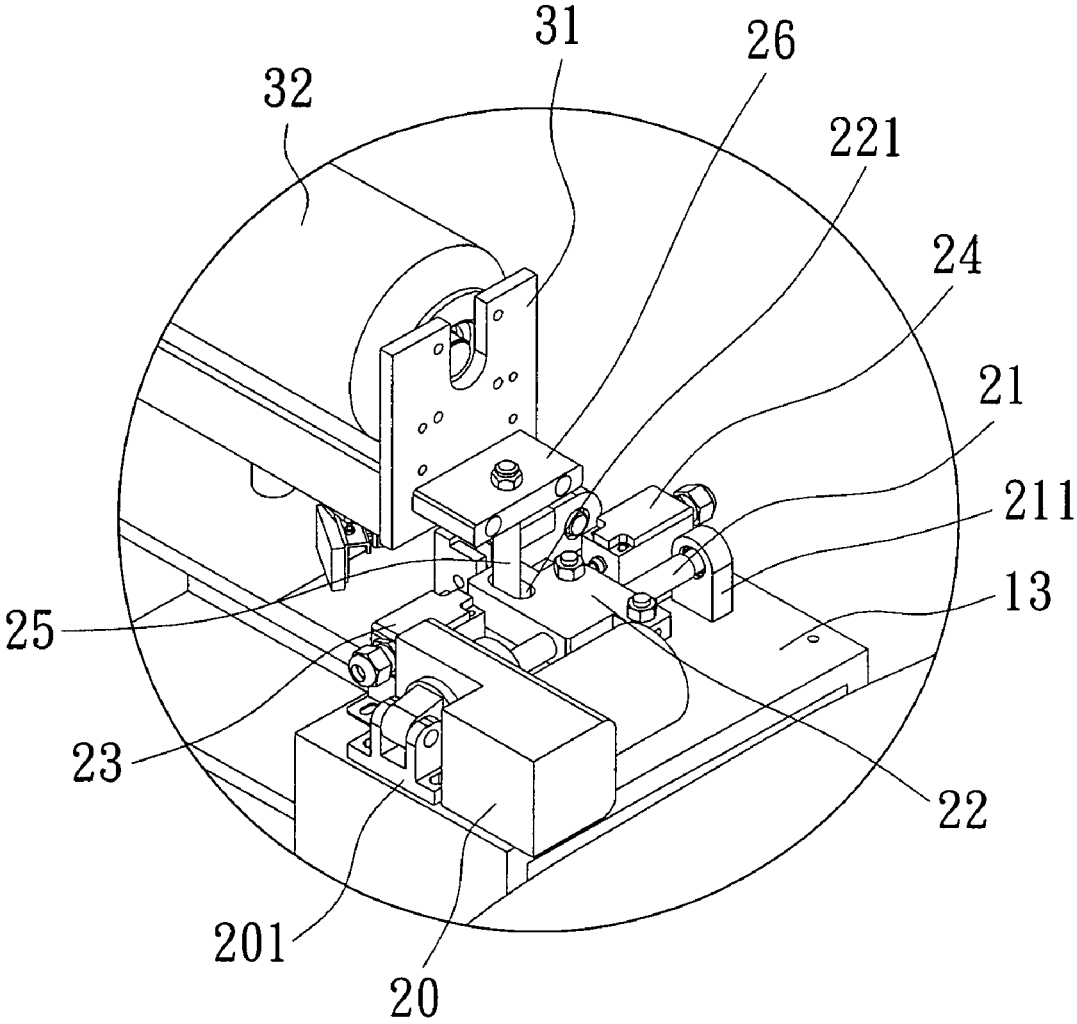
FIG. 2A shows an enlarged view of the swing device of the present invention.
Figure 3:
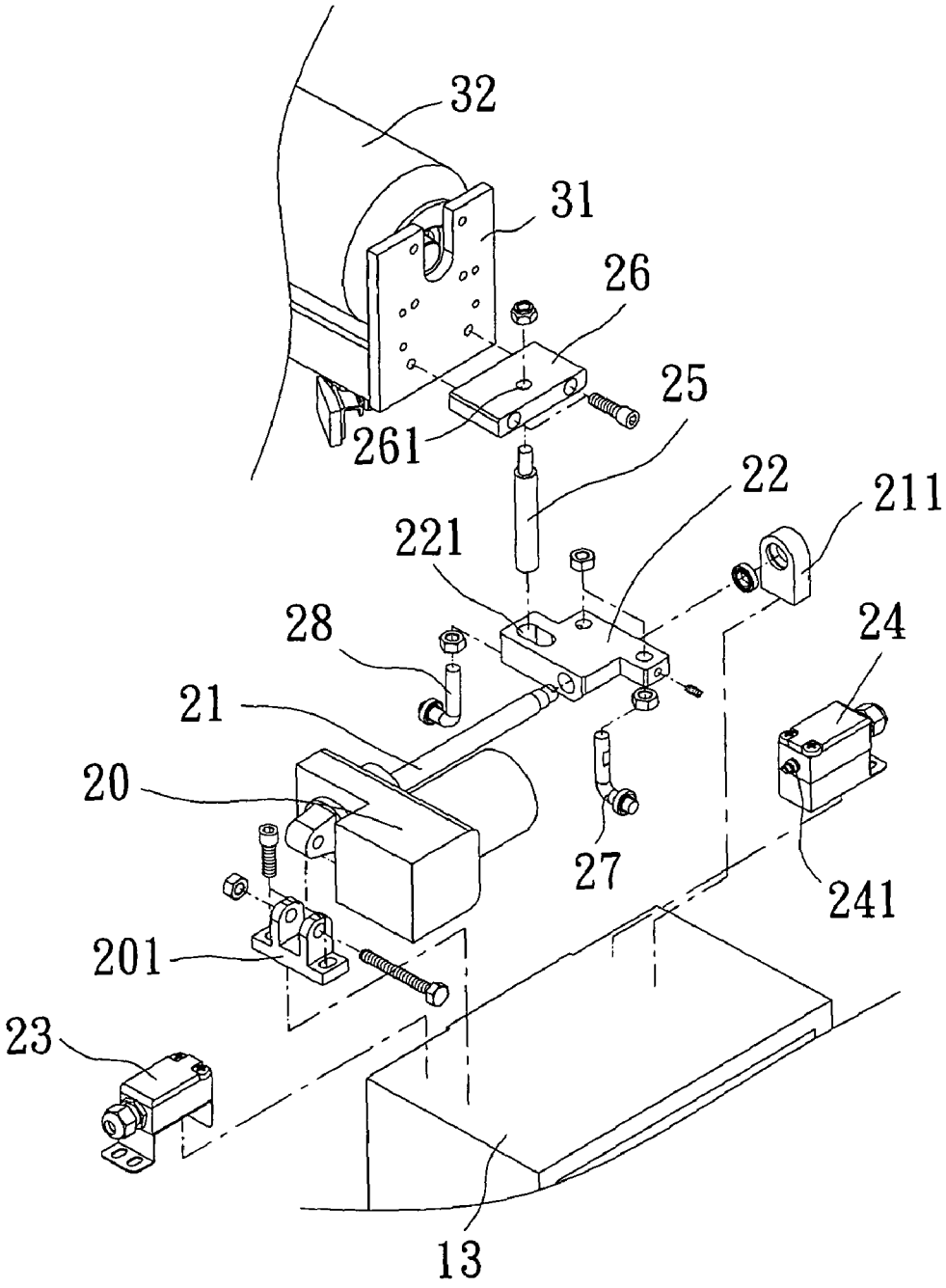
FIG. 3 is an exploded view to show the swing device of the present invention.
Figure 4:
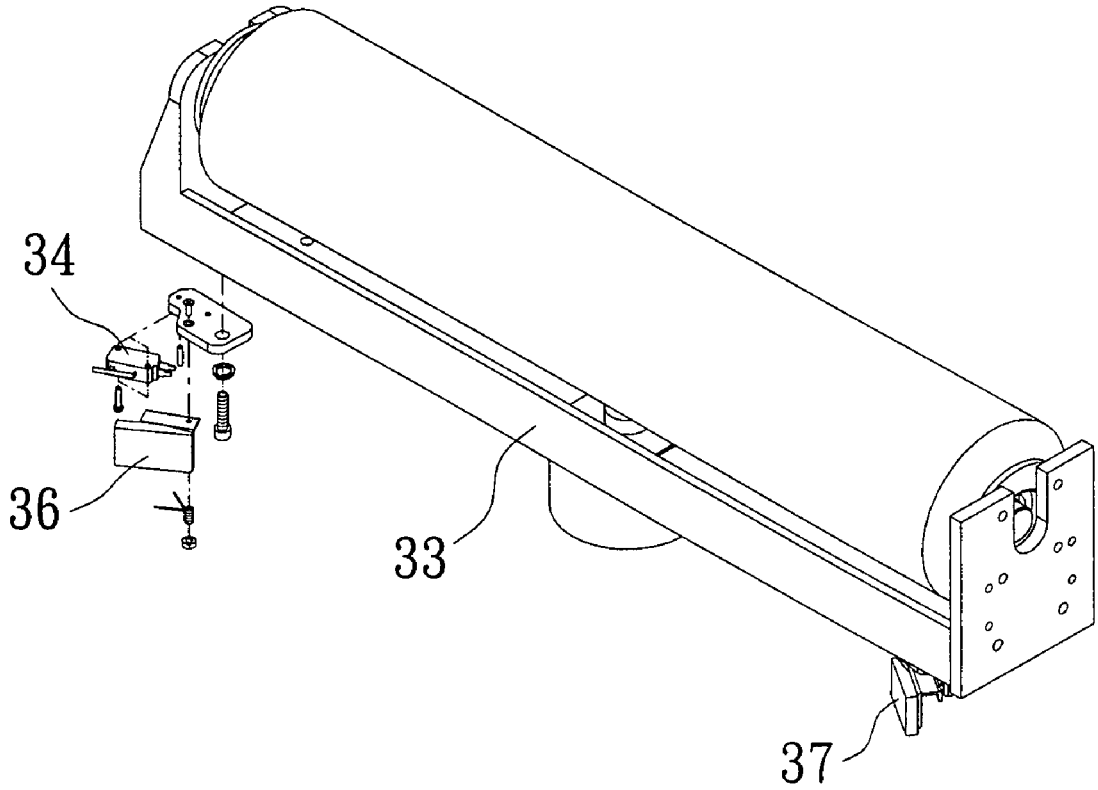
FIG. 4 shows one of the two micro switches of the swing device of the present invention.

Referring to FIG. 1, the grinding machine 10 includes a feeding table 11 and a frame 12 is located above the feeding table 11. A sanding unit 30 is connected to the frame 12 and includes two mandrels 32 which are rotatably connected to the frame 12 and a sanding belt 40 (FIG. 5) is rotatably mounted to the two mandrels 32. The objects to be polished is fed on the feeding table 11 and polished by the sanding belt 40.

Referring to FIGS. 2A to 5, the swing device of the present invention comprises a fixed table 13 connected to an end of the frame 12 of the grinding machine 10 and a motor 20 is connected to a fixing member 201 on the fixed table 13 and includes a shaft 21 which is rotatably supported on the support member 211. A movable member 22 is movably mounted to the shaft 21 and two support rolling members 27, 28 connected to two sides of the movable member 22. The two support rolling members 27, 28 are connected with two rollers which roll on the fixed table 13 when the movable member 22 moves. The movable member 22 had an elongate slot 221. A link 25 has a first end engaged with a hole 261 in the fixed plate 26 which is connected to an end of one of the two mandrels 32, and a second end of the link 25 is movably inserted into the elongate slot 221 of the movable member 22.

Two limit switches 23, 24 are connected on the fixed table 13 and the movable member 22 is movable between the two limit switches 23, 24. Two action ends 231, 241 are connected to the two limit switches 23, 24 respectively and face the movable member 22.

Two micro switches 34, 35 are connected to a support frame 33 and located on two sides of the sanding belt 40. The support frame 33 supports one of the two mandrels 32.

Referring to FIGS. 6 to 9, the movable member 22 is movable along the shaft 21 when the shaft 21 rotates and the movable member 22 activates the two action ends 231, 241 of the two limit switches 23, 24 alternatively. When the two action ends 231, 241 of the two limit switches 23, 24 are touched, the operation of the motor 20 is stopped. The micro switches 34, 35 are activated by the sanding belt 40 to change rotation direction of the shaft 21.

Figure 5:
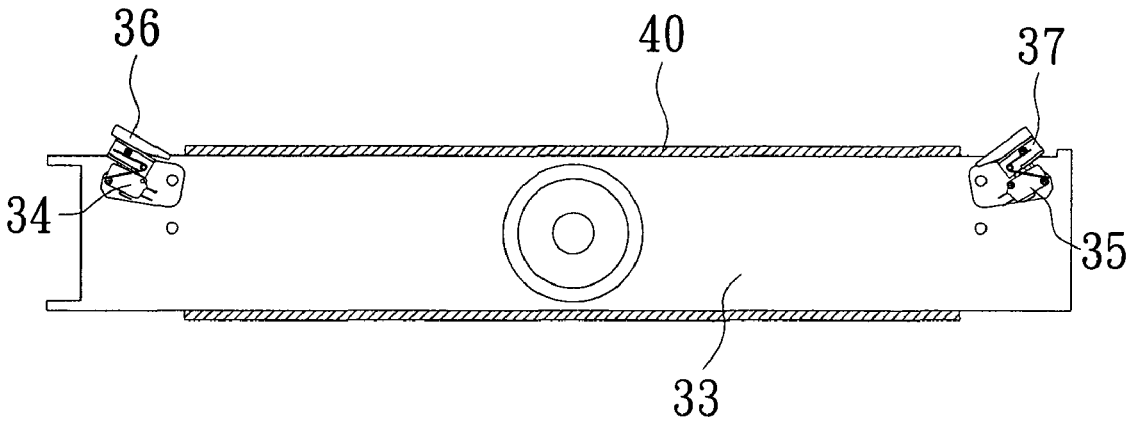
FIG. 5 shows the position relationship of the sanding unit and the micro switches.

FIG. 5 shows the sanding unit 30 is not activated and the sanding belt 40 is located at the center portion and does not touch any of the two micro switches 34, 35. When the motor

Figure 6:
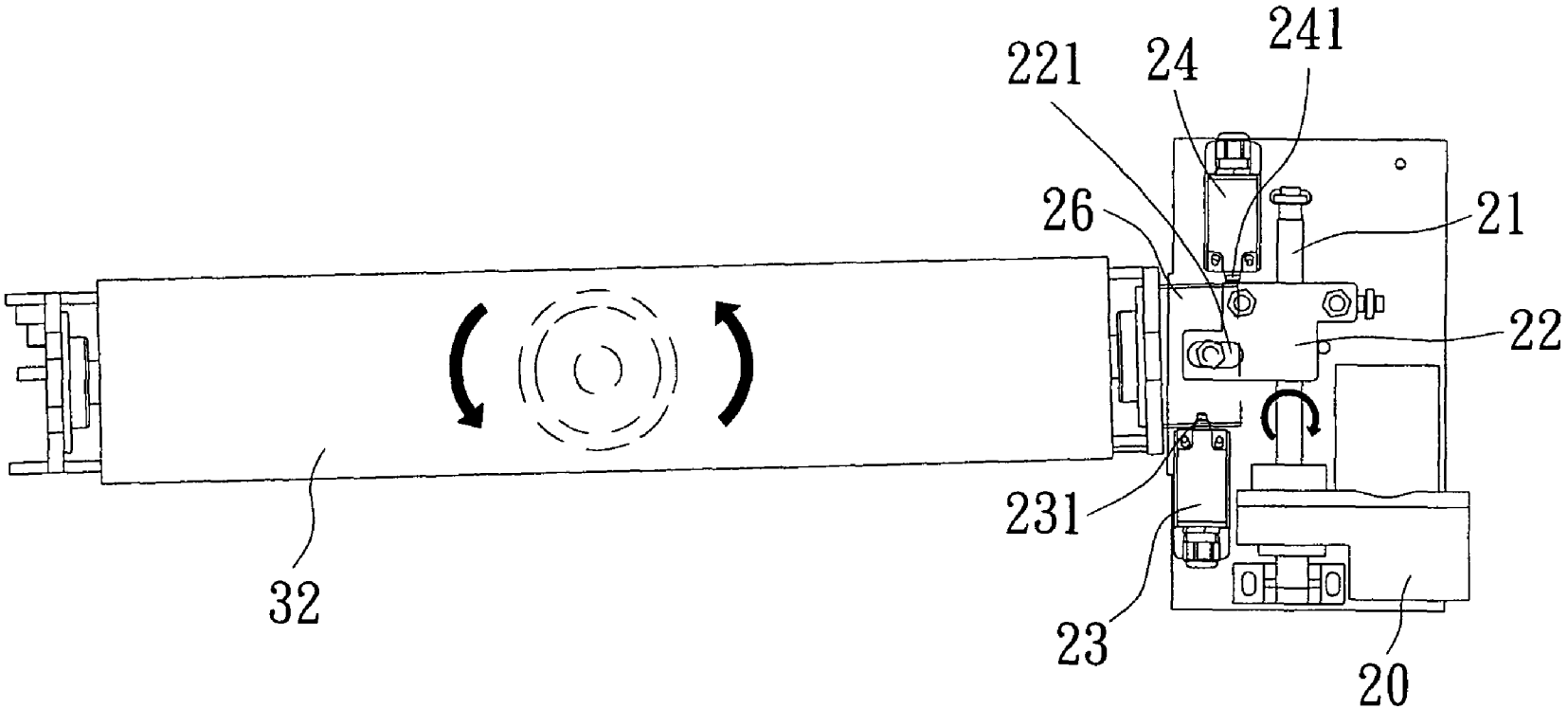
FIG. 6 shows that the movable member moves one end of the sanding unit.
Figure 7:
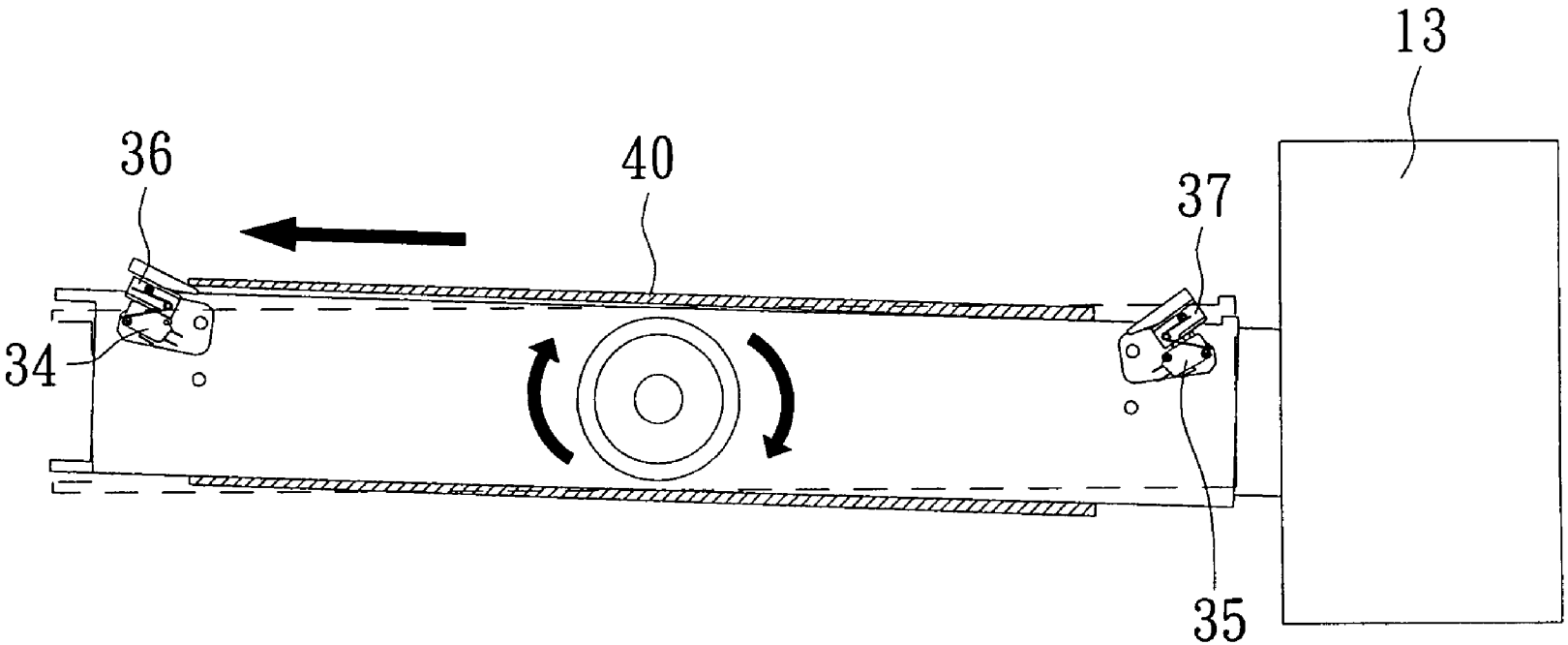
FIG. 7 shows that the sanding unit swings.
Figure 8:
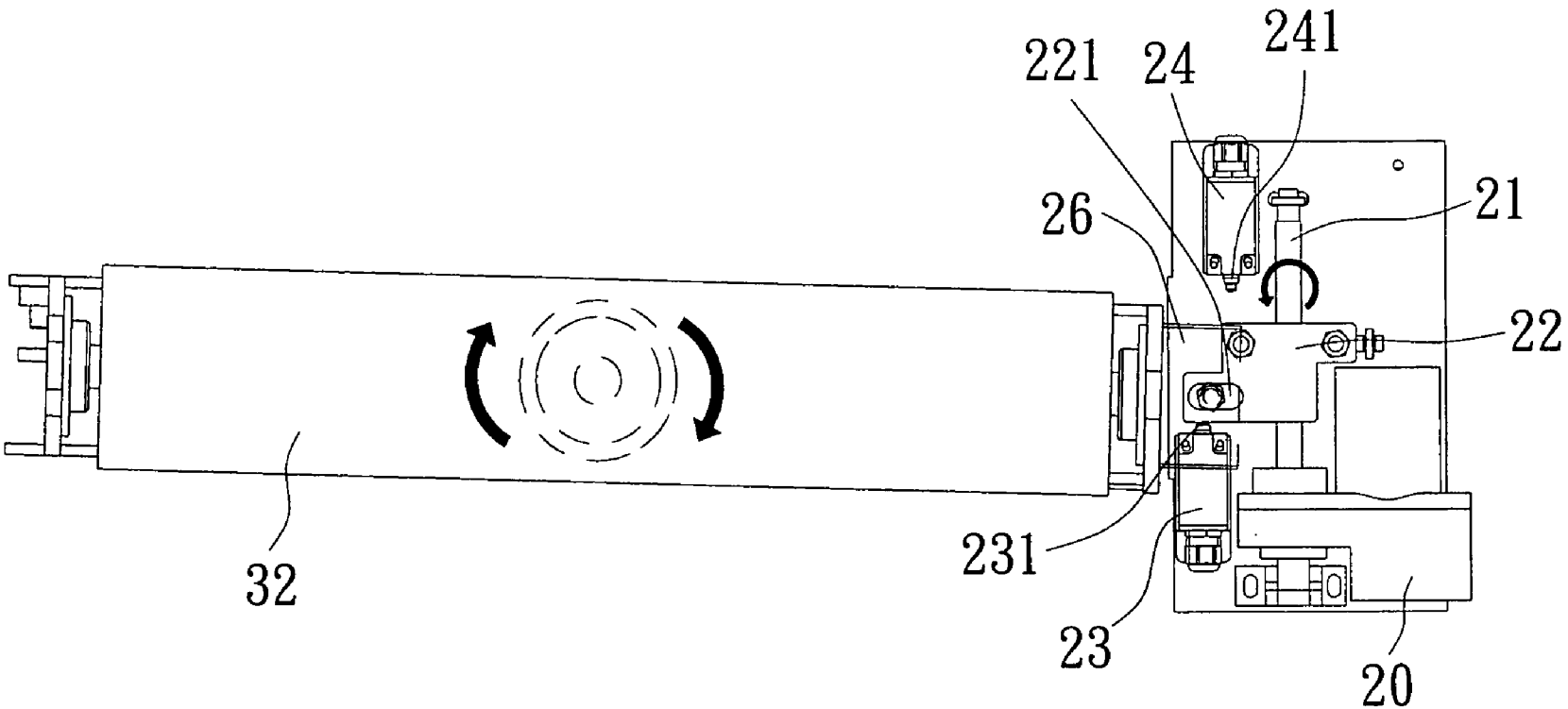
FIG. 8 shows that the movable member moves the other end of the sanding unit.
Figure 9:
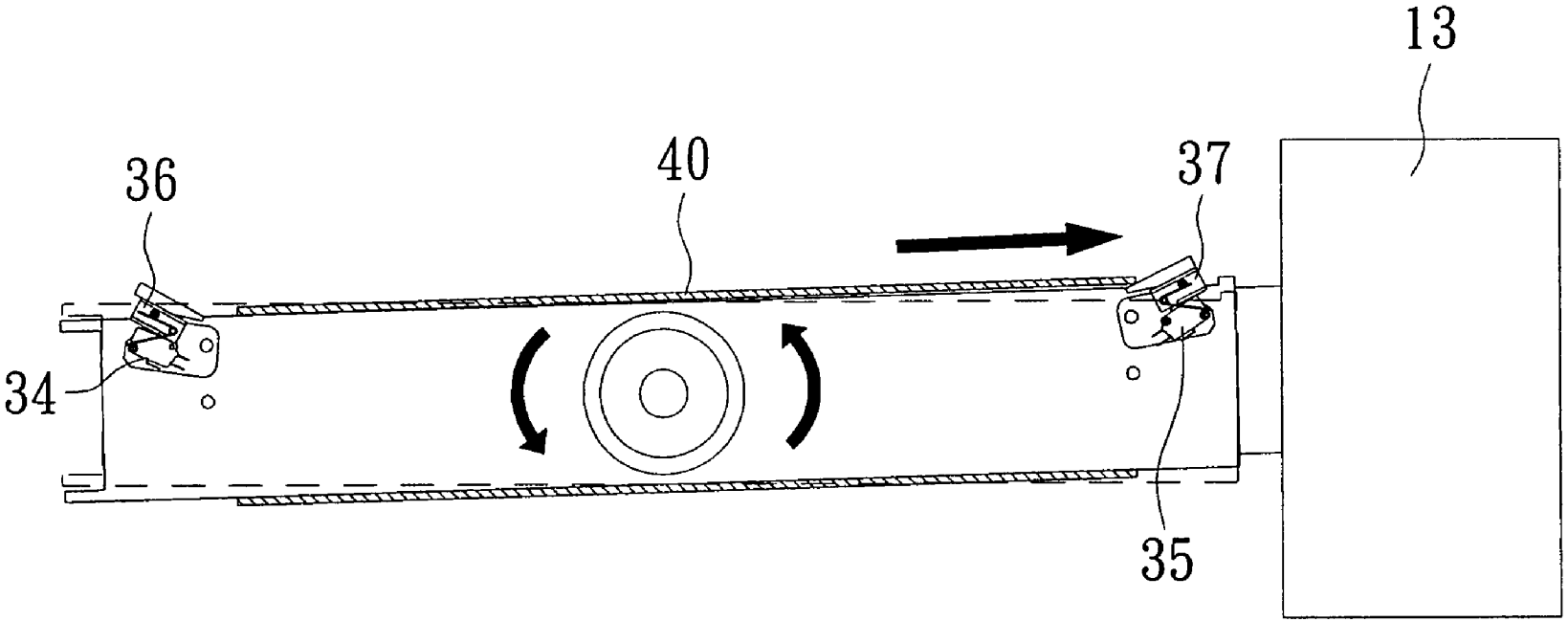
FIG. 9 shows that the sanding unit swings to the other direction.

20 operates, the shaft 21 rotates clockwise, the movable member 22 moves and the sanding unit 30 swings an angle, when the movable member 22 touches the action end 241, the motor 20 stops and the sanding belt 40 moves toward a side as shown in FIG. 6 and FIG. 7 which is a bottom view of FIG. 6. When the lever 36 of the micro switch 34 is touched, the rotation direction of the shaft 21 rotates counter clockwise and the movable member 22 moves to the other direction. The sanding unit 30 swings to the other side as shown in FIG. 8. When the movable member 22 touches the action end 231 of the limit switch 23, the motor 20 stops. When the sanding belt 40 swings and touches the lever 37 of the other micro switch 35, the shaft 21 rotates clockwise again as shown in FIG. 9. The sanding unit 30 and the sanding belt 40 are swing back and forth such that the sanding portion of the sanding belt 40 is much wider and does not constantly contact the objects to be polished. This reduces accumulation of debris of the objects and increases the life of the sanding belt 40.

Figure 10:
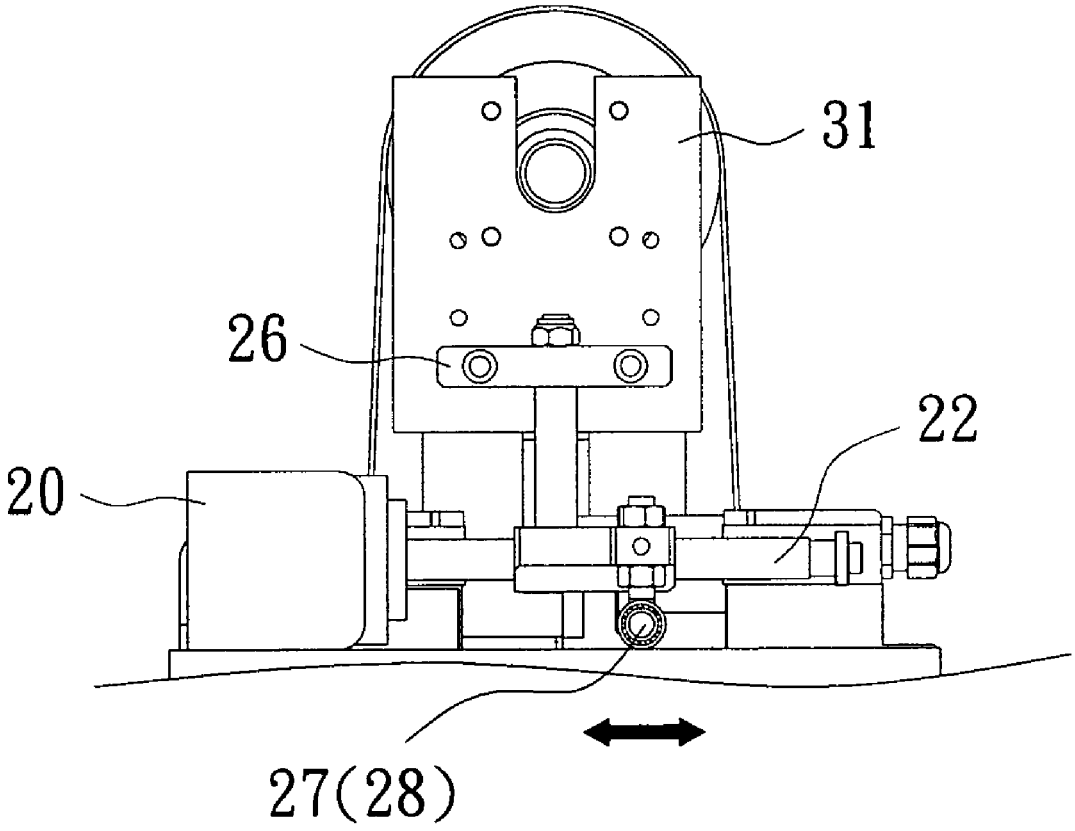
FIG. 10 shows the two support rolling members roll on the fixed table when the movable member moves.

FIG. 10 shows that the rollers on the support rolling members 27, 28 roll on the fixed table 13 when the movable member 22 moves and ensure the movable member 22 to move in stable manner.

While we have shown and described the embodiment in accordance with the present invention, it should be clear to those skilled in the art that further embodiments may be made without departing from the scope of the present invention.

What is claimed is:

1. A swing device for a grinding machine comprising:

a feeding table;

a frame located above the feeding table;

two rotating stems rotatably connected to the frame and a sanding belt rotatably mounted to the two rotating stems;

a fixed table adapted to be connected to an end of the frame of the grinding machine;

a motor connected to a fixing member on the fixed table and including a shaft which is rotatably supported on a support member;

a movable member movably mounted to the shaft and two support rolling members connected to two sides of the movable member, the movable member having an elongated slot;

a fixed plate fixed to an end plate which is adapted to be connected to an end of one of the two rotating stems, the fixed plate having a hole and a link having a first end engaged with the hole and a second end of the link movably inserted into the elongated slot;

two limit switches connected on the fixed table and the movable member being movable between the two limit switches, two action ends connected to the two limit switches respectively;

two micro switches connected to a support frame and adapted to be located on two sides of the sanding belt, the support frame adapted to support one of the two rotating stems, and the movable member being movable along the shaft and activating the two action ends of the two limit switches alternatively to stop operation of the motor, the micro switches adapted to be activated by the sanding belt to change a rotation direction of the shaft.

2. The device as claimed in claim 1, wherein the two action ends on the two limit switches face the movable member.

3. The device as claimed in claim 1, wherein the end plate together with the fixed plate are adapted to swing a sanding unit including the two rotating stems and the sanding belt.

4. The device as claimed in claim 1, wherein each of the two micro switches has a lever extending therefrom which is activated by the sanding belt.

5. The device as claimed in claim 1, wherein the two support rolling members are connected with two rollers which roll on the fixed table when the movable member moves.

* * * * *